US010293452B2

(12) United States Patent
Yoshimura et al.

(10) Patent No.: US 10,293,452 B2
(45) Date of Patent: May 21, 2019

(54) HONING METHOD AND INNER CAM WITH C-SHAPED CROSS SECTION

(71) Applicant: HONDA MOTOR CO., LTD., Tokyo (JP)

(72) Inventors: Takuro Yoshimura, Tochigi-ken (JP); Fumio Sato, Tochigi-ken (JP); Hiroshi Takeda, Tochigi-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 283 days.

(21) Appl. No.: 15/458,436

(22) Filed: Mar. 14, 2017

(65) Prior Publication Data

US 2017/0266776 A1 Sep. 21, 2017

(30) Foreign Application Priority Data

Mar. 18, 2016 (JP) ..... 2016-055095

(51) Int. Cl.
*B24B 19/12* (2006.01)
*B24B 33/04* (2006.01)

(52) U.S. Cl.
CPC ..... *B24B 19/12* (2013.01); *B24B 33/04* (2013.01)

(58) Field of Classification Search
CPC ..... B24B 19/12; B24B 33/04
See application file for complete search history.

(56) References Cited

U.S. PATENT DOCUMENTS

2006/0174724 A1* 8/2006 Hoffmann ..... F01L 1/047 74/567

FOREIGN PATENT DOCUMENTS

DE 102014109827 A1 * 1/2016 ..... B24B 19/12
JP 58-155167 9/1983

OTHER PUBLICATIONS

Chinese Office Action dated Aug. 28, 2018 with English translation, 10 pages.

* cited by examiner

*Primary Examiner* — Marc Carlson
(74) *Attorney, Agent, or Firm* — Rankin, Hill & Clark LLP

(57) ABSTRACT

An inner cam has a substantially C-shaped cross section, an arcuately shaped inner circumferential surface of which is ground with high precision by such a honing method. The inner circumferential surface has a discontinuous portion. The honing method includes a fixing step and a grinding step. A plurality of inner cams, in which openings are provided between both ends thereof in the circumferential direction, are stacked, and the arcuately shaped inner circumferential surfaces thereof are subjected to grinding. In the fixing step, the relative positions of the plurality of inner cams are fixed such that a resultant force against the inner cams arranged on both end sides in the stacking direction, and a resultant force against the inner cams arranged on a central side in the stacking direction are opposed to each other mutually at a center location of the stacking direction.

5 Claims, 7 Drawing Sheets

HONING METHOD AND INNER CAM WITH C-SHAPED CROSS SECTION

CROSS-REFERENCE TO RELATED APPLICATION

This application is based upon and claims the benefit of priority from Japanese Patent Application No. 2016-055095 filed on Mar. 18, 2016, the contents of which are incorporated herein by reference.

BACKGROUND OF THE INVENTION

Field of the Invention

The present invention relates to a honing method by which an arcuately shaped inner circumferential surface, in which a discontinuous portion is provided between both ends thereof in a circumferential direction, is subjected to grinding. The present invention further relates to an inner cam having a substantially C-shaped cross section, the inner circumferential surface of which is subjected to grinding by such a honing method.

Description of the Related Art

In the case of finishing an inner circumferential sliding surface of a cylindrical workpiece, preferably a honing process is adopted from the standpoints of facilitating mass production and achieving superior lubrication performance. A honing head that is used for honing is shaped substantially in the form of a cylinder, and a plurality of rod-shaped grindstones, which extend along the axial direction, are attached at intervals along the circumferential direction thereof. The honing head is inserted into the interior of a workpiece so that the direction of extension of the grindstones lies along an axial center, and while the grindstones are rotated, grinding is enabled by placing the grindstones in contact with the workpiece and applying an appropriate surface pressure to the inner circumferential surface of the workpiece.

In such a honing process, in the case that a groove or an opening or the like is formed to extend along the axial center on the inner circumferential surface of the workpiece, or stated otherwise, in the case that the inner circumferential surface of the workpiece is arcuately shaped with a discontinuous portion being provided between both ends in the circumferential direction of the workpiece, a concern arises in that it becomes difficult to perform grinding satisfactorily. More specifically, if the distance between both end portions that form the discontinuous portion is greater than the width of the grindstones, the grindstones will enter into the discontinuous portion during grinding. Consequently, since a deviation occurs between the axis of the workpiece and the center of rotation of the honing head, it can be assumed that it will become difficult to grind the inner circumferential surface of the workpiece evenly, and thus machining precision is lowered.

Thus, according to Japanese Laid-Open Patent Publication No. 58-155167, when honing an inner circumferential surface of a workpiece having a groove formed therein with grindstones having a width narrower than the width of the groove, the following method for suppressing a reduction in machining accuracy has been proposed. More specifically, a plurality of workpieces are stacked and retained in such a manner that positions of the grooves in the circumferential direction differ from each other, and honing is performed thereon simultaneously by bringing the grindstones into contact with inner circumferential surfaces of the workpieces. In accordance therewith, the grindstones as a whole are prevented from entering into the grooves, and a deviation between the axial centers of the workpieces and the center of rotation of the honing head is suppressed.

SUMMARY OF THE INVENTION

However, with the method disclosed in Japanese Laid-Open Patent Publication No. 58-155167, in which circumferential positions of the grooves of the stacked workpieces differ from each other respectively, when honing is carried out, grinding is caused to be performed intermittently by repeatedly bringing grindstones into and out of contact with respect to the inner circumferential surfaces of the workpieces. In this case, since the machining load continuously fluctuates, ultimately, it becomes difficult to grind the inner circumferential surfaces of the workpiece with high precision.

A principal object of the present invention is to provide a honing method, which is capable of highly accurately grinding an arcuately shaped inner circumferential surface in which a discontinuous portion is formed.

Another object of the present invention is to provide an inner cam having a substantially C-shaped cross section, the inner circumferential surface of which is ground with high precision by such a honing method.

According to an embodiment of the present invention, a honing method is provided for grinding an inner circumferential surface of a workpiece comprising an arcuately shaped inner circumferential surface in which a discontinuous portion is provided between both ends thereof in a circumferential direction, comprising a fixing step of stacking a plurality of the workpieces and fixing relative positions mutually therebetween, and a grinding step of grinding inner circumferential surfaces of the plurality of workpieces by rotating a honing head on which a plurality of grindstones are mounted at intervals along the circumferential direction, the grindstones extending along hollow axial centers formed inside of the stacked workpieces. Concerning a machining load, which is applied in the grinding step to each of the workpieces in directions orthogonal to the axial centers, and with respect to portions of the inner circumferential surfaces that are opposed to the discontinuous portions with the axial centers intervening therebetween, in the fixing step, the relative positions of the plurality of workpieces are fixed such that a resultant force against the workpieces arranged on both end sides in the stacking direction, and a resultant force against the workpieces arranged on a central side in the stacking direction are opposed to each other mutually at a center location of the stacking direction.

Hereinafter, in the grinding step, the machining load, which is applied in a direction orthogonal to the axial centers and with respect to portions of the inner circumferential surfaces that are opposed to the discontinuous portions with the axial centers of the workpieces intervening therebetween, may also be referred to simply as a machining load. With the workpieces in which the relative positioning therebetween is fixed in the foregoing manner, a resultant force (first resultant force) of the machining load on both end sides in the stacking direction is produced at the center location of the stacking direction. The first resultant force is mutually opposite in direction to another resultant force (second resultant force) of the machining load of the workpieces on a central side in the stacking direction, and is of the same magnitude.

Therefore, according to the machining method of the present invention, the machining load of the plurality of workpieces as a whole can be balanced at the center location in the stacking direction. In accordance therewith, it is possible to prevent the grindstones from becoming inclined with respect to the direction of extension, as well as to suppress fluctuations in the machining load, and the arcuately shaped inner circumferential surfaces in which the discontinuous portions are formed can be ground with high precision.

In the above-described honing method, in the fixing step, an even number of workpieces preferably are stacked, and among the plurality of workpieces, a total number of end side workpieces, which are arranged on one end side and another end side in the stacking direction, and a total number of central side workpieces, which are arranged on a central side in the stacking direction, are equal to each other, all of the end side workpieces are arranged such that circumferential positions of the discontinuous portions thereof are all located at a first position in the circumferential direction, all of the central side workpieces are arranged such that circumferential positions of the discontinuous portions thereof are all located at a second position in the circumferential direction, and the relative positions of the plurality of workpieces preferably are fixed such that the first position in the circumferential direction and the second position in the circumferential direction differ by 180 degrees in the circumferential direction.

In this case, the first resultant force and the second resultant force can easily be balanced at the center location of the stacking direction, and in accordance therewith, the arcuately shaped inner circumferential surfaces in which the discontinuous portions are formed can be ground with high precision.

In the above-described honing method, in the case that a distance between side surfaces, which are maximally spaced apart in the circumferential direction of at least two adjacently arranged grindstones, is smaller than a distance between both of the ends having the discontinuous portion interposed therebetween, the honing method according to the present invention can suitably be applied.

In the above-described honing method, the workpiece preferably is an inner cam having a substantially C-shaped cross section, and in which an opening is provided between both ends in the circumferential direction. It is necessary for the inner circumferential sliding surface of such an inner cam to be ground with high accuracy, and therefore, the honing method according to the present invention can suitably be applied to this requirement.

According to another embodiment of the present invention, an inner cam is provided having a substantially C-shaped cross section in which an opening is provided between both ends thereof in a circumferential direction, and which is mounted through the opening and from a diametrical direction thereof onto an outer shaft of a camshaft, wherein crosshatching formed by honing markings is formed on an inner circumferential sliding surface, and a circularity deviation thereof is less than 10 μm.

The inner cams according to the present invention can be mass produced by the honing method, and since the inner circumferential surfaces thereof are machined highly accurately with high performance surface properties suitable for sliding, the product quality of such inner cams is superior.

The above and other objects, features, and advantages of the present invention will become more apparent from the following description when taken in conjunction with the accompanying drawings, in which a preferred embodiment of the present invention is shown by way of illustrative example.

DESCRIPTION OF THE PREFERRED EMBODIMENTS

A preferred embodiment of a honing method according to the present invention, as well as an inner cam having an inner circumferential surface which is ground by the honing method, will be described in detail below with reference to the accompanying drawings.

Figure 1:
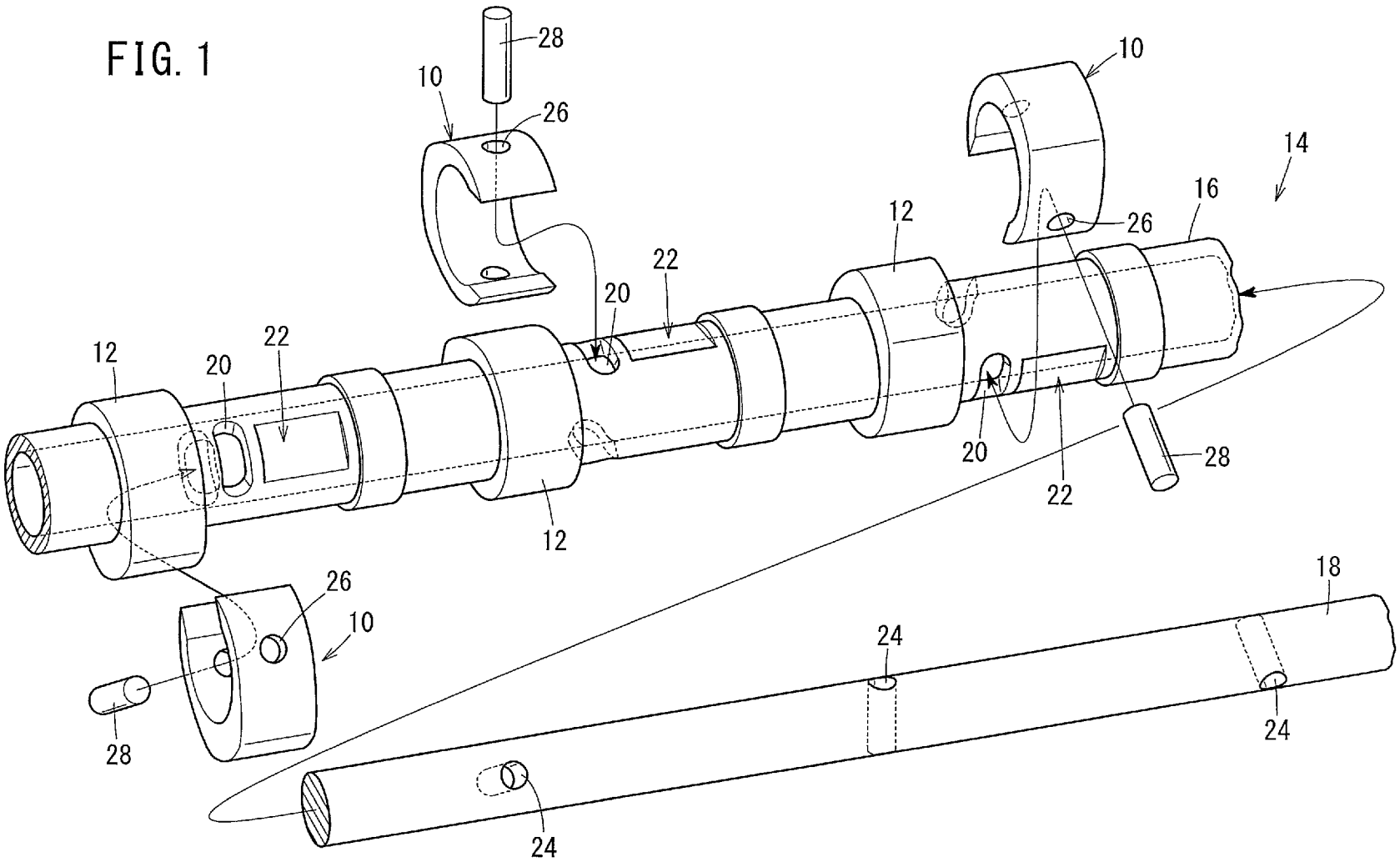
FIG. 1 is an outline exploded perspective view of a cam shaft equipped with inner cams according to an embodiment of the present invention.
Figure 2:
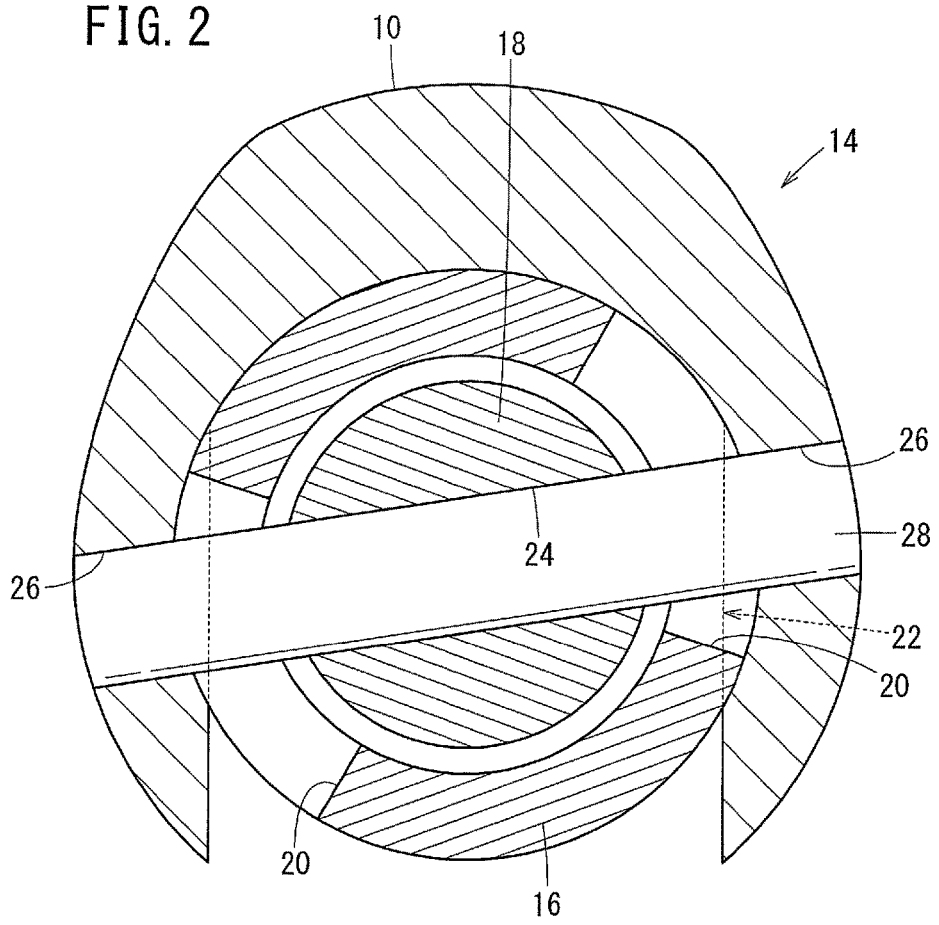
FIG. 2 is a schematic cross-sectional view of a region where an inner cam of the cam shaft of FIG. 1 is fixed.

As shown in FIGS. 1 and 2, inner cams 10 according to the present embodiment are provided on a camshaft 14 adjacent to outer cams 12 along an axial direction, and rocker arms (not shown) are driven together with the outer cams 12. In accordance with this feature, engine valves provided in the cylinders of an internal combustion engine (none of which are shown) are opened and closed. According to the present embodiment, three sets of inner cams 10 and outer cams 12 are provided in order to open and close engine valves of a three-cylinder internal combustion engine.

At first, a description will be given in detail concerning the structure of the camshaft 14. The camshaft 14 is equipped with a cylindrical outer shaft 16, with the outer cams 12 being formed integrally on the outer circumference thereof, an inner shaft 18 is arranged rotatably inside the outer shaft 16, and the inner cams 10 are fixed to the inner shaft 18, as will be described later. The outer cams 12 are constituted from three individual members, which are disposed at predetermined intervals along the axial direction of the outer shaft 16. As shown in FIG. 1, the orientations of the major axes of the adjacent outer cams 12 are arranged at angles obtained by dividing 360 degrees by three, which coincides with the number of the cylinders. More specifically, the major axes of the outer cams are arranged at angles of 120 degrees, respectively.

Three pairs of notches 20, which are disposed respectively adjacent to locations where the three outer cams 12 are provided, are formed on the outer shaft 16. Each of the pairs of notches 20 is disposed in mutually confronting relation in the diametrical direction of the outer shaft 16. Further, each of the notches 20 is of an arcuate shape extending along the circumferential direction of the outer shaft 16. Among the locations on both sides adjacent to the notches 20 of the outer shaft 16, small diameter portions 22 are formed respectively on sides opposite to the outer cams 12. The small diameter portions 22 are locations at which opposite ends in the diametrical direction of the outer circumferential wall of the outer shaft 16 are cutout in order to partially reduce the outer diameter of the outer shaft 16.

The inner shaft 18 is a solid round bar having a smaller diameter than the inner diameter of the outer shaft 16. Therefore, by disposing the inner shaft 18 coaxially in the interior of the outer shaft 16, a clearance is formed mutually between the inner circumferential surface of the outer shaft 16 and the outer circumferential surface of the inner shaft 18. Further, three pin holes 24, which serve as through holes that extend along the diametrical direction of the inner shaft 18, are provided at intervals along the axial direction of the inner shaft 18.

The inner cams 10 are substantially C-shaped in cross section, in which an opening is provided between both ends in the circumferential direction thereof. The inner cams 10 of the outer shaft 16 are constituted from three individual members which are slidably mounted along the circumferential direction, respectively, at locations adjacent to the outer cams 12 of the outer shaft 16. The distance between both end portions that form the openings of the inner cams 10 is slightly greater than the outer diameter of the small diameter portions 22 of the outer shaft 16, and less than the outer diameter of locations of the outer shaft 16 where the inner cams 10 are mounted.

In accordance therewith, after inserting the small diameter portions 22 of the outer shaft 16 into the inner cams 10 through the openings, and by sliding the inner cams 10 along the axial direction of the outer shaft 16, the inner cams 10 can be installed at positions adjacent to the outer cams 12. At this time, because the length of the inner cams 10 in the circumferential direction is set so as to cover one half (180 degrees) or more in the circumferential direction of the outer shaft 16, detachment or separation of the inner cams 10 from the outer shaft 16 can be prevented.

As described above, in the camshaft 14, the profiles of the inner cams 10 are used only for portions whose phases are shifted with respect to the outer cams 12. Therefore, by forming the inner cams 10 to be substantially C-shaped in cross section, with the locations thereof at which the profiles are not used being provided as openings, the weight of the inner cams 10 can be reduced in comparison with a cylindrically shaped inner cam. Further, the cost can be reduced by reducing the amount of material required to form the inner cams 10. Furthermore, by forming the inner cams 10 to be substantially C-shaped in cross section, the inner cams 10 can be installed with respect to the outer shaft 16 from the diametrical direction thereof, after the outer cams 12 have been provided thereon. Therefore, it is possible to simplify the manufacturing process for the camshaft 14, and to enhance efficiency of the manufacturing process for the camshaft 14.

In each of the inner cams 10, a pair of insertion holes 26 are formed that confront the notches 20 and the pin holes 24 when the inner cams 10 are installed on the outer shaft 16 in the aforementioned manner. As shown in FIG. 2, the inner cams 10 are fixed to the inner shaft 18 by insertion of pins 28 into the pin holes 24 through the insertion holes 26 and the notches 20. As a result, the inner cams 10 are capable of rotating together with the inner shaft 18.

More specifically, by rotating the inner shaft 18 relatively with respect to the outer shaft 16, the inner cams 10 rotate in following relation with the inner shaft 18 (in so-called corotation therewith), and slide in the circumferential direction along the outer circumferential surface of the outer shaft 16. As a result, relative positioning between the outer cams 12 and the inner cams 10 can be made variable, and consequently, it is possible to arbitrarily control the opening times of the engine valves.

Figure 3:
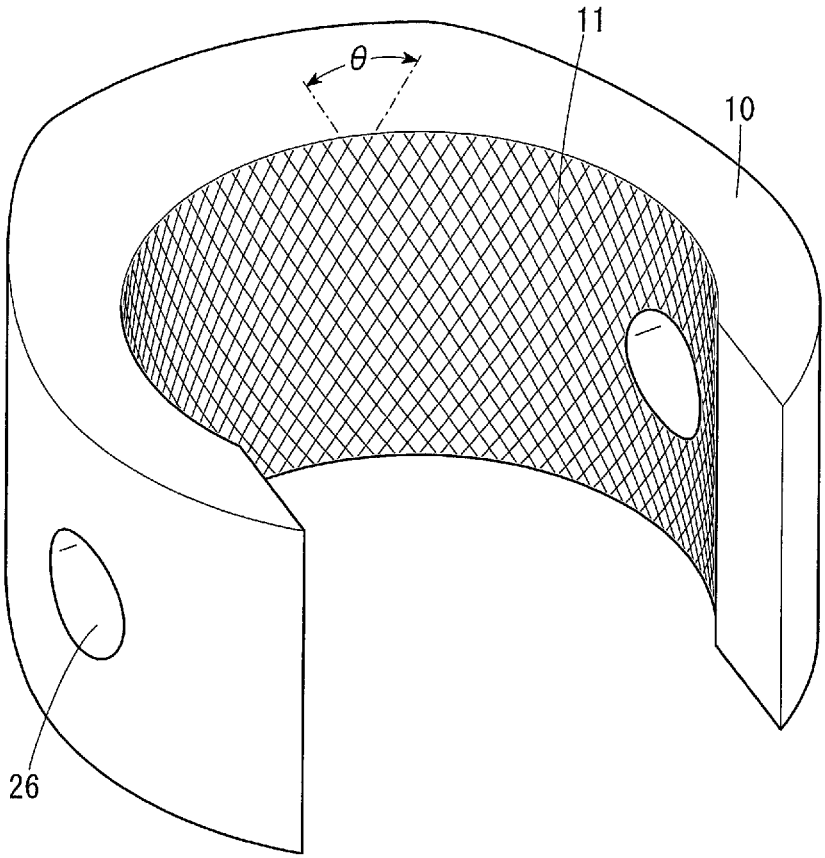
FIG. 3 is a schematic perspective view for describing crosshatching that is formed on inner circumferential sliding surfaces of the inner cams of FIG. 1.

Further, as shown in FIG. 3, by subjecting the inner cams 10 to a grinding process by honing, on the inner circumferential surfaces thereof, crosshatching 11 which is honing markings is formed, and a circularity deviation thereof is less than 10 μm. An intersecting angle 2θ (crosshatching angle) of the crosshatching 11 forms grooves of 0° to 180°, which serve as oil reservoirs, thereby imparting satisfactory lubrication to the sliding surfaces. In other words, the inner cams 10 possess satisfactory circularity as a result of grinding the inner circumferential sliding surfaces with high precision by means of the honing process, which is superior in terms of enabling the inner cams 10 to be mass produced. In accordance with this feature, the inner circumferential surfaces of the inner cams 10 and the outer circumferential surface of the outer shaft 16 are made to slide suitably along the circumferential direction, and it is possible to adjust with high accuracy the relative positioning of the inner cams 10 with respect to the outer cams 12.

The honing method according to the present invention, as described above, can suitably be applied to inner circumferential surfaces of the inner cams 10 having a substantially C-shape in cross section, which are obtained by being ground with high precision. Therefore, according to the present embodiment, a case has been described as an example in which the workpieces to be honed are inner cams 10. However, the invention is not limited in particular to this feature, and the honing method according to the present invention can be applied in a similar manner to the case of grinding an inner circumferential surface of any workpiece equipped with an arcuately shaped inner circumferential surface and provided with a discontinuous portion between both end portions thereof in the circumferential direction.

Figure 4:
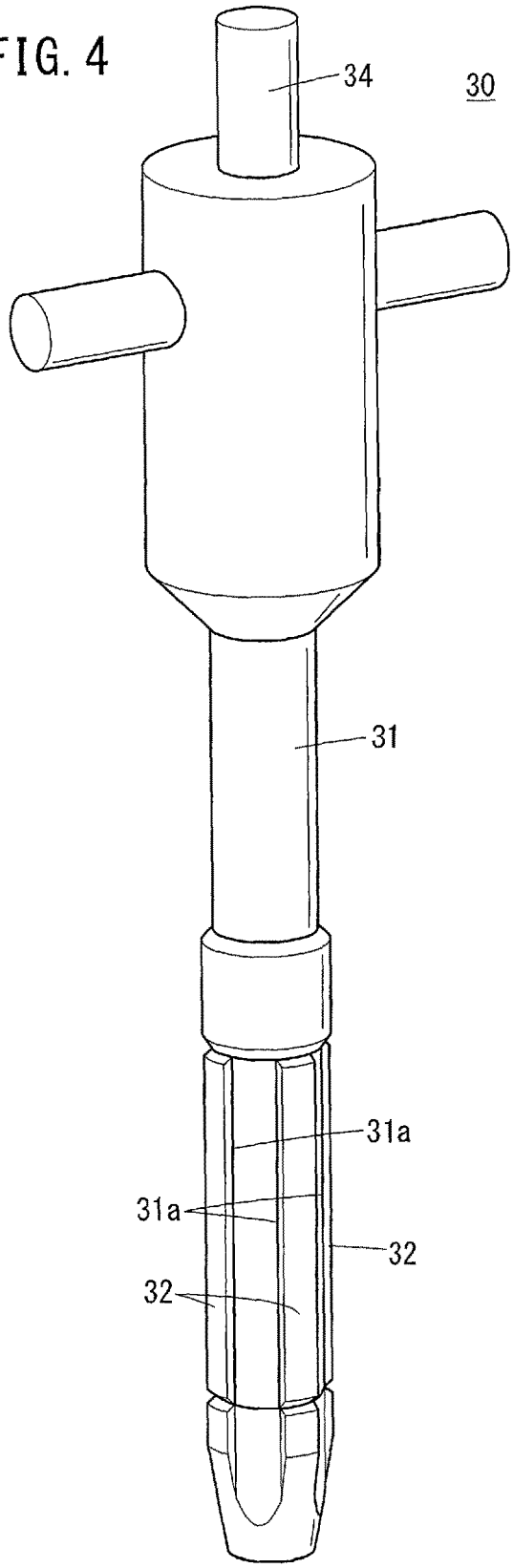
FIG. 4 is a schematic frontal view of a principal part of a honing head that carries out honing on inner circumferential surfaces of the inner cams of FIG. 1.
Figure 5:
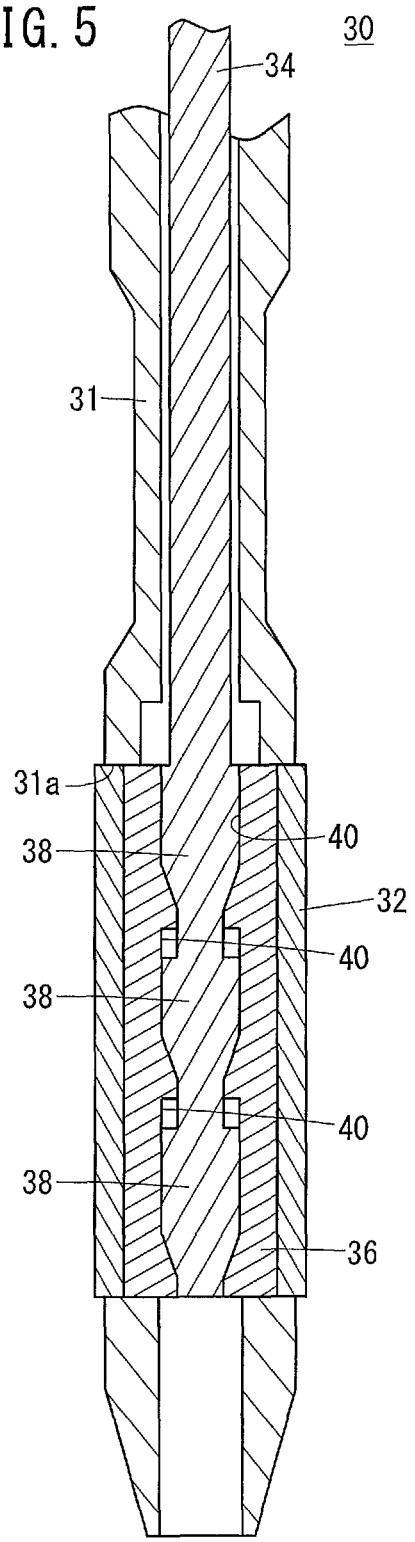
FIG. 5 is a partial cross-sectional view of the honing head of FIG. 4.

The honing method can be carried out using a honing head 30, as shown in FIGS. 4 and 5. The honing head 30 has a substantially cylindrical shape, with a rear end side thereof being connected to a mounting portion (not shown) of a machining device in a floating state via a universal joint or the like, for example. Therefore, as will be discussed later, it is possible for the honing head 30 to be displaced in the axial direction along the hollow axial centers of the plurality of stacked inner cams 10, the relative positions of which are fixed. Further, the honing head 30 can be raised and lowered along the axial direction by the machining device.

More specifically, the honing head 30 is equipped with a substantially cylindrical main shaft section 31, grindstones 32, an expanding/contracting bar 34, and grindstone shoes 36. Four notches 31*a* are formed on a distal end of the main shaft section 31, and as will be discussed later, the grindstones 32 are capable of protruding outwardly through the notches 31*a*. The grindstones 32 are constituted from four individual members (see FIG. 6) which are mounted at intervals along the circumferential direction of the main shaft section 31, and are shaped in the form of bars that extend along the axial direction of the main shaft section 31. Further, the distance between side surfaces that are maximally spaced apart in the circumferential direction of at least two adjacently arranged grindstones 32 is smaller than the distance between both ends of the inner cams 10 that form the openings therein.

The expanding/contracting bar 34 is disposed in the interior of the main shaft section 31 substantially coaxially with the main shaft section 31. A proximal end side thereof is attached to the machining device through a spring (not shown), and together therewith, expanded diameter portions 38 having tapered surfaces are formed at a plurality of locations (at three positions in the present embodiment) on the distal end side of the expanding/contracting bar 34. The expanding/contracting bar 34 is biased constantly at all times by the spring toward the distal end side of the main shaft section 31, and is movable in the axial direction toward a rear end side of the main shaft section 31 in the event that the expanding/contracting bar 34 is pulled by the machining device in opposition to the biasing force of the spring.

The grindstone shoes 36 are constituted by four members in the same number as the grindstones 32, and are disposed inside the main shaft section 31 between the expanded diameter portions 38 and the grindstones 32. The grindstone shoes 36 and the grindstones 32 are fixed together integrally, and are urged resiliently by a spring band (not shown) or the like toward the axial center of the main shaft section 31. Concave portions 40 having tapered surfaces with shapes corresponding to the tapered surfaces of the expanded diameter portions 38 are formed in locations of the grindstone shoes 36 that face toward the expanding/contracting bar 34.

Consequently, when the expanding/contracting bar 34 is moved toward the distal end side of the main shaft section 31, the tapered surfaces of the expanded diameter portions 38 slide along the tapered surfaces of the concave portions 40, and therefore, the grindstone shoes 36 are pressed by the expanding/contracting bar 34. Owing to this feature, the grindstone shoes 36 are moved in a direction away from the axial center of the main shaft section 31 in opposition to the biasing force of the spring band. As a result, the length (protruding amount) at which the grindstones 32, which are fixed integrally to the grindstone shoes 36, protrude outwardly through the notches 31*a* from the outer circumferential surface of the main shaft section 31 is increased.

Conversely, when the expanding/contracting bar 34 is moved toward the proximal end side of the main shaft section 31, since the grindstones 32 can be moved toward the axial center side of the main shaft section 31, the protruding amount can be made smaller, or can be reduced to zero. By the relative position of the expanding/contracting bar 34 with respect to the main shaft section 31 being adjusted in this manner, since the amount at which the grindstones 32 protrude can be adjusted, the magnitude of the surface pressure applied to the machining surface during honing thereof can be adjusted. FIGS. 4 and 5 show a condition in which the projecting amount is maximized. Further, in the present embodiment, although a spring is used for biasing the expanding/contracting bar 34, a hydraulic cylinder may be used instead of a spring.

Figure 6:
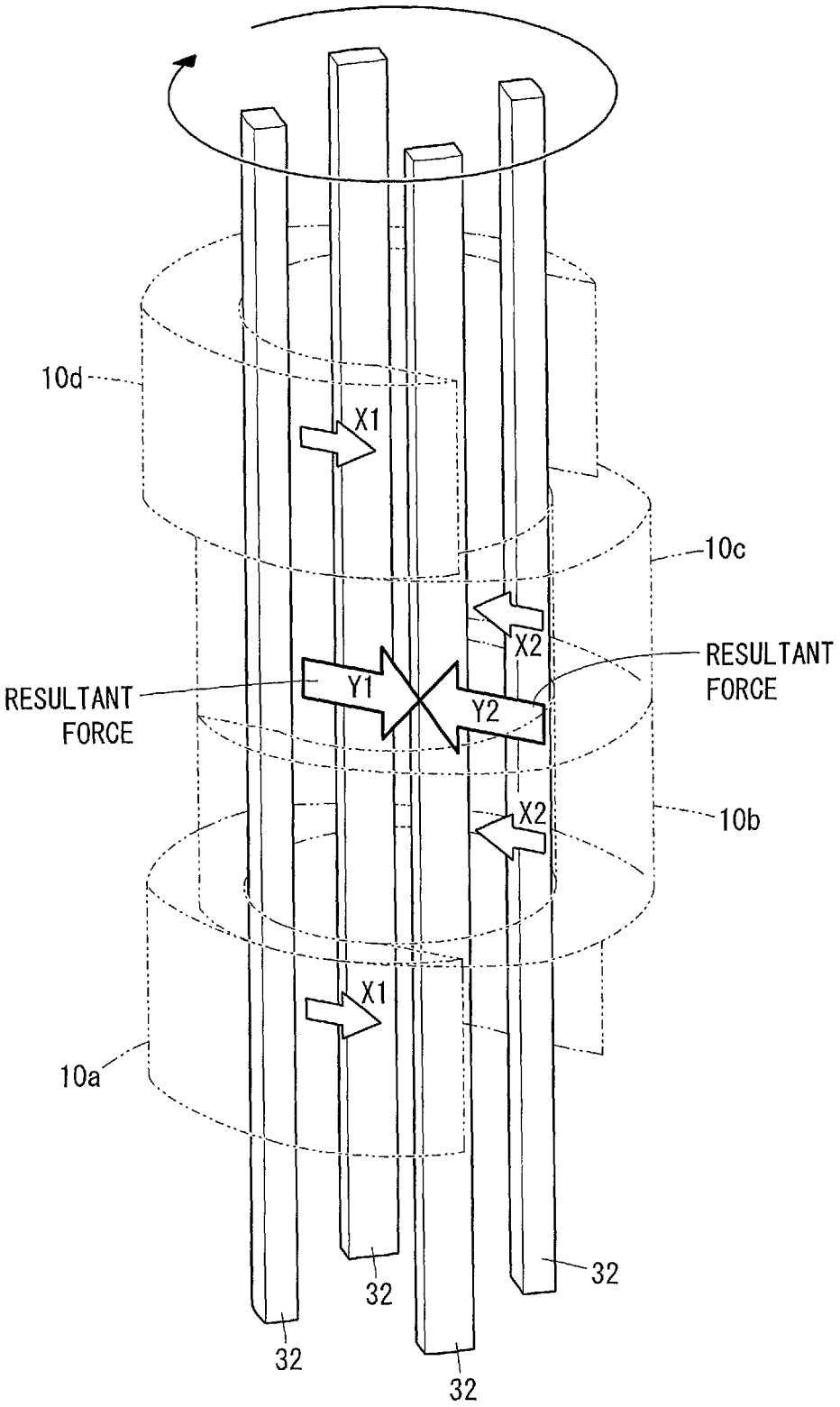
FIG. 6 is an explanatory drawing for providing a description of the honing method according to the present invention.

In the honing method according to the present embodiment, at first, the inner cams 10 are disposed downwardly of the honing head 30, so that the distal end side of the lowered honing head 30 is inserted into the hollow region of the inner cams 10, and a fixing step is carried out by a workpiece holder (not shown) to fix the inner cams 10 in place. Next, as shown in FIG. 6, the honing head 30 is lowered, and while the grindstones 32 are rotated in a state in which the direction in which the grindstones 32 extend is aligned with the hollow axial centers of the stacked inner cams 10, the grindstones 32 are brought into contact with, and an appropriate surface pressure is applied to the inner circumferential surfaces of the inner cams 10.

In accordance therewith, the grinding step is carried out for grinding the inner circumferential surfaces of the plurality of inner cams 10. At this time, the machining load, which is applied in a direction orthogonal to the axial centers and with respect to locations of the inner circumferential surfaces that are opposed to the openings with the axial centers of the inner cams 10 intervening therebetween, may also be referred to simply as a machining load.

With the honing method, in the fixing step, by fixing the relative positions of the plurality of individual inner cams 10 in the manner described below, it becomes possible in the grinding step to grind the inner circumferential surfaces of the inner cams 10 with high precision.

According to the present embodiment, as the plurality of inner cams 10, four individual inner cams 10 are stacked, and the relative positioning therebetween is fixed.

Hereinafter, in order to distinguish the four inner cams 10 from each other, the inner cams 10 may be referred to, from a lower side in the stacking direction, as a first inner cam 10*a*, a second inner cam 10*b*, a third inner cam 10*c*, and a fourth inner cam 10*d*. Stated otherwise, the first inner cam 10*a*, the second inner cam 10*b*, the third inner cam 10*c*, and the fourth inner cam 10*d* may also be referred to collectively as the inner cams 10.

A resultant force of the machining loads X1 applied to the first inner cam 10*a* and the fourth inner cam 10*d* (end side workpieces), which are arranged on both end sides in the stacking direction, is regarded as a first resultant force Y1. Further, a resultant force of the machining loads X2 applied to the second inner cam 10*b* and the third inner cam 10*c* (central side workpieces), which are arranged at a central side in the stacking direction, is regarded as a second resultant force Y2. The relative positions of the first through fourth inner cams 10*a* to 10*d* are fixed so that the first resultant force Y1 and the second resultant force Y2 are oriented in mutually opposite directions at the center location of the stacking direction.

Stated otherwise, the positions of the openings of the first inner cam 10*a* and the fourth inner cam 10*d* in the circumferential direction, the first inner cam 10*a* and the fourth inner cam 10*d* being two in total and arranged on both end sides in the stacking direction, are placed mutually in the same first position in the circumferential direction. Further, the positions of the openings of the second inner cam 10*b* and the third inner cam 10*c* in the circumferential direction, the second inner cam 10*b* and the third inner cam 10*c* being two in total and arranged on a central side in the stacking direction, are placed mutually in the same second position in the circumferential direction. The relative positions of the first through fourth inner cams 10*a* to 10*d* are fixed in such a manner that the first position in the circumferential direction and the second position in the circumferential direction differ by 180 degrees in the circumferential direction.

By carrying out the grinding step in this state, the machining load against the first through fourth inner cams 10*a* to 10*d* as a whole can be balanced at the center location of the stacking direction. In accordance therewith, it is possible to prevent the grindstones 32 from becoming inclined with respect to the direction of extension, as well as to suppress fluctuations in the machining load, and the inner circumferential surfaces of the first through fourth inner cams 10*a* to 10*d* can be ground with high precision. On the inner circumferential surfaces of the inner cams 10 that are ground in this manner, crosshatching 11 is formed thereon as honing markings. Further, since the circularity deviation can be made less than 10 μm, as noted above, the inner circumferential surfaces of the inner cams 10 and the outer circumferential surface of the outer shaft 16 are made to slide suitably along the circumferential direction, and it is possible to adjust with high accuracy the relative positioning of the inner cams 10 with respect to the outer cams 12.

Figure 7:
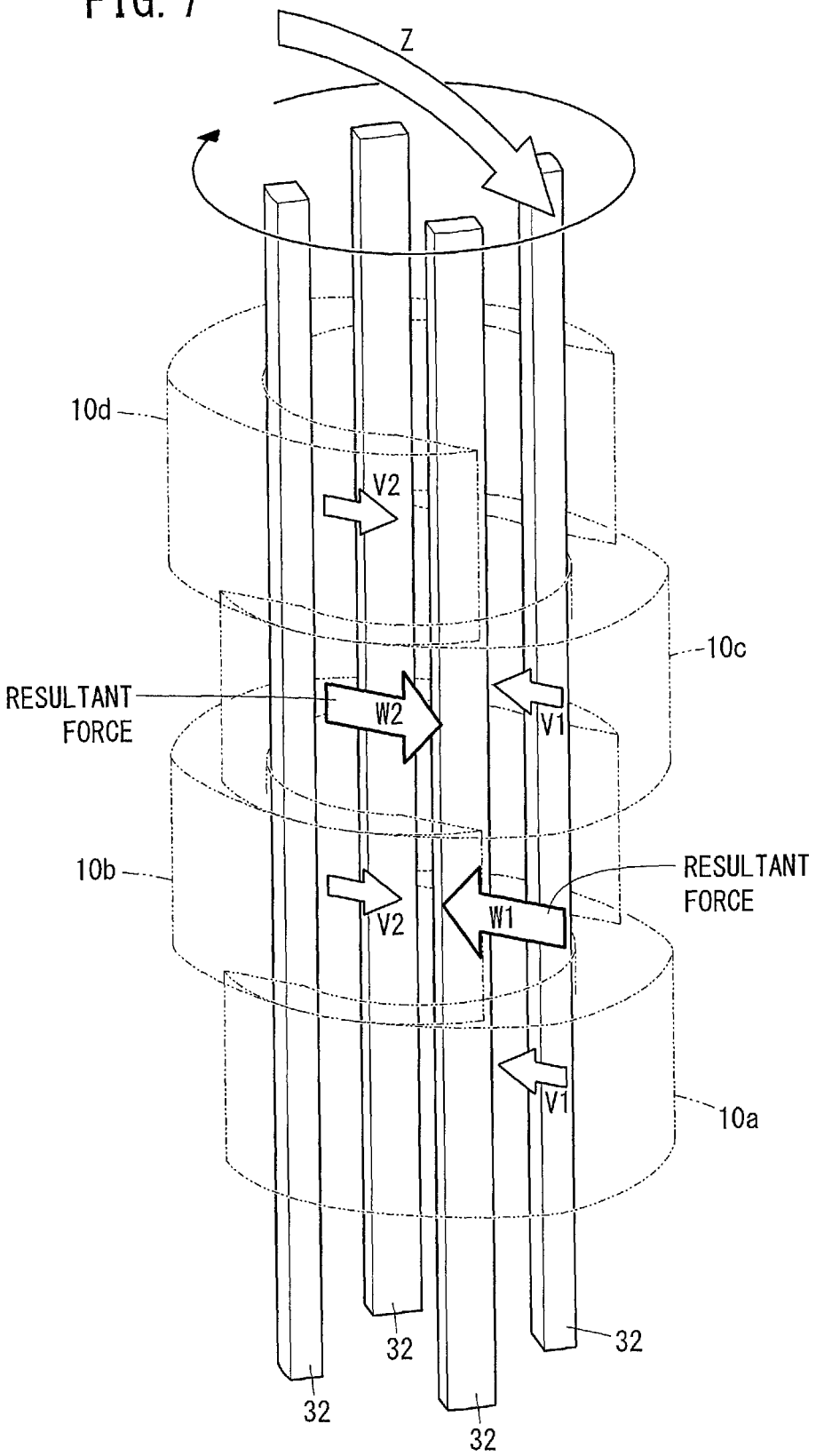
FIG. 7 is an explanatory drawing for providing a description of the honing method according to a comparative example.

For example, as in the comparative example shown in FIG. 7, when the inner cams 10 are stacked such that the positions of the openings of adjacent inner cams 10 in the circumferential directions differ mutually from each other, the total machining load at the center in the stacking direction cannot be balanced. More specifically, with the resultant force W1 of the machining loads V1 against the first inner cam 10*a* and the third inner cam 10*c*, for which the positions of the openings thereof in the circumferential direction are the same, and the resultant force W2 of the machining loads V2 against the second inner cam 10*b* and the fourth inner cam 10*d*, although the magnitudes thereof are the same, the positions in the stacking direction do not coincide with each other.

For this reason, a force acts that causes the grindstones 32 (the honing head 30) to become inclined in the direction Z from the axial center. Consequently, the hollow axial centers of the inner cams 10 and the center of rotation of the honing head 30 fluctuate continuously, and machining accuracy is deteriorated. As a result, it is difficult to obtain inner cams 10 having a circularity deviation of less than 10 μm.

As understood from the above, according to the honing method of the present embodiment, the arcuately shaped inner circumferential surfaces of the inner cams 10 in which the openings are formed can be ground with high precision. Further, since the four individual inner cams 10 can be subjected to grinding simultaneously, the method is superior in terms of mass production and machining efficiency.

The present invention is not limited in particular to the above-described embodiment, and various modifications can be made thereto without deviating from the essence and gist of the present invention.

In the honing method according to the aforementioned embodiment, four inner cams 10 are stacked and the relative positioning therebetween is fixed. However, the number of inner cams 10 to be stacked is not necessarily limited to four. For example, in the case that eight of such inner cams 10 are stacked, two each of the inner cams 10 are arranged on one end side and the other end side in the stacking direction, resulting in a total of four inner cams 10 being arranged such that the positions of the openings thereof in the circumferential direction are placed in the first position in the circumferential direction. Further, the four inner cams 10 on the central side in the stacking direction are arranged such that the positions of the openings thereof in the circumferential direction are placed in the second position in the circumferential direction. In accordance therewith, since the machining load against the inner cams 10 as a whole can be balanced at the center location of the stacking direction, it is possible to prevent the grindstones 32 from becoming inclined with respect to the direction of extension, as well as to suppress fluctuations in the processing load, and the inner circumferential surfaces of the inner cams 10 can be ground with high precision.

Further, with the honing method according to the above-described embodiment, the honing head 30 which is equipped with four grindstones 32 is used. However, the number of grindstones 32 may be any number, so long as the number is a plurality.

Furthermore, although the inner cams 10 according to the above-described embodiment are provided on the camshaft 14 for use in a three-cylinder internal combustion engine, the number of cylinders of the internal combustion engine is not limited to three.

While the invention has been particularly shown and described with reference to preferred embodiments, it will be understood that variations and modifications can be effected thereto by those skilled in the art without departing from the scope of the invention as defined by the appended claims.

What is claimed is:

1. A honing method for grinding an inner circumferential surface of a workpiece comprising an arcuately shaped inner circumferential surface with a central axis in which a discontinuous portion is provided between both ends thereof in a circumferential direction, comprising:

a fixing step comprising:

stacking a plurality of the workpieces along a stacking axis forming a stack with a first of the workpieces on an end side, a second of the workpieces on an another end side, and at least one of the workpieces stacked therebetween, and fixing relative positions of the plurality of workpieces by fixing the first of the workpieces on the end side positioned with the central axis coincident with the stacking axis and the discontinuous portion oriented in a first direction relative to the stacking axis, fixing the second of the workpieces on the another end side positioned with the central axis coincident with the stacking axis and the discontinuous portion oriented in the first direction relative to the stacking axis, and fixing the at least one of the workpieces stacked therebetween positioned with the central axis coincident with the stacking axis and the discontinuous portion oriented in a second direction relative to the stacking axis, wherein the first direction and second direction are opposite relative to each other; and a grinding step of simultaneously grinding the inner circumferential surfaces of the plurality of workpieces by rotating, about the stacking axis, a honing head on which a plurality of grindstones are mounted at intervals along the circumferential direction;

wherein, a machining load is applied in the grinding step to simultaneously to:

create a first force in the first of the workpieces on the end side in a primary load direction away from the discontinuous portion, create a second force in the second of the workpieces on the another end side in the primary load direction, and create a third force in the at least one of the workpieces stacked therebetween in a secondary load direction opposite to the primary load direction.

2. A honing method for grinding an inner circumferential surface of a workpiece comprising an arcuately shaped inner circumferential surface with a central axis in which a discontinuous portion is provided between both ends thereof in a circumferential direction, comprising:

a fixing step comprising:

stacking a plurality of the workpieces along a stacking axis forming a stack with a first group of the workpieces stacked on an end side, a second group of the workpieces stacked on an another end side, and a third group of the workpieces stacked therebetween, and fixing relative positions of the plurality of workpieces by fixing the first group of the workpieces stacked on the end side positioned with the central axes of the first group of the workpieces coincident with the stacking axis and the discontinuous portions of the first group of the workpieces oriented in a first direction relative to the stacking axis, fixing the second group of the workpieces stacked on the another end side positioned with the central axes of the second group of the workpieces coincident with the stacking axis and the discontinuous portions of the second group of the workpieces oriented in the first direction relative to the stacking axis, and fixing the third group of the workpieces stacked the rebetween positioned with the central axes of the third group of the workpieces coincident with the stacking axis and the discontinuous portions of the third group of the workpieces oriented in a second direction relative to the stacking axis, wherein the first direction and second direction are opposite relative to each other; and a grinding step of simultaneously grinding the inner circumferential surfaces of the plurality of workpieces by rotating, about the stacking axis, a honing head on which a plurality of grindstones are mounted at intervals along the circumferential direction;

wherein, a machining load is applied in the grinding step to simultaneously to:

create a first force in the first group of the workpieces on the end side in a primary load direction away from the discontinuous portion, create a second force in the second group of the workpieces on the another end side in the primary load direction, and create a third force in the third group of the workpieces stacked therebetween in a secondary load direction opposite to the primary load direction.

3. The honing method according to claim 1, wherein the plurality of grindstones are mounted at intervals that are maximally spaced apart along the circumferential direction wherein a distance between at least two adjacently arranged grindstones is smaller than a distance between the both ends having the discontinuous portion interposed therebetween.

4. The honing method according to claim 1, wherein the workpiece is an inner cam having a substantially C-shaped cross section in which an opening is provided between both ends in the circumferential direction.

5. The honing method according to claim 2, wherein: in the fixing step, a total number of the plurality of the workpieces is an even number, a total number of the first group of workpieces, a total number of the second group of workpieces is equal, and a total number of the third group of workpieces is equal to a collective number of the first group of workpieces and the second group of workpieces, and wherein the first direction and second direction differ by 180 degrees relative to each other.

* * * * *